US007229541B2

(12) United States Patent
Hara et al.

(10) Patent No.: US 7,229,541 B2
(45) Date of Patent: Jun. 12, 2007

(54) PROCESSING SOLUTION TANK

(75) Inventors: Hideaki Hara, Aichi (JP); Toshinori Watanabe, Aichi (JP)

(73) Assignee: Trinity Industrial Corporation, Aichi (JP)

( * ) Notice: Subject to any disclaimer, the term of this patent is extended or adjusted under 35 U.S.C. 154(b) by 357 days.

(21) Appl. No.: 10/896,932

(22) Filed: Jul. 23, 2004

(65) Prior Publication Data

US 2005/0139472 A1 Jun. 30, 2005

(30) Foreign Application Priority Data

Dec. 26, 2003 (JP) ..... 2003-434705

(51) Int. Cl.
*B01D 57/02* (2006.01)

(52) U.S. Cl. ..... 204/471; 204/511; 204/512; 204/626; 204/623

(58) Field of Classification Search ..... 204/471, 204/511, 512, 626, 623, 625
See application file for complete search history.

(56) References Cited

U.S. PATENT DOCUMENTS 3,496,082 A * 2/1970 Orem et al. ..... 204/482
6,139,708 A * 10/2000 Nonomura et al. ..... 204/482

FOREIGN PATENT DOCUMENTS

JP 11-200092 7/1999
JP 2002-60998 2/2002

OTHER PUBLICATIONS

English Language Abstract of JP 11-200092, Jul. 27, 1999.
English Language Abstract of JP 2002-60998, Feb. 28, 2002.

* cited by examiner

*Primary Examiner*—Nam Nguyen
*Assistant Examiner*—Luan V. Van
(74) *Attorney, Agent, or Firm*—Greenblum & Bernstein, P.L.C.

(57) ABSTRACT

A processing solution tank of forming an agitating flow by flowing and circulating a processing solution in directions opposite to each other between the side of a liquid surface and the side of a tank bottom, in which a guide plate substantially of an arcuate shape is formed to an end of the tank situated at least to the downstream on the side of the liquid surface or the downstream on the side of the tank bottom in the agitating flow for reversing the flow downward to the tank bottom or upward to the liquid surface, and a swirl chamber having a swirl generating portion of a substantially arcuate face for capturing dusts is provided at the bottom of the tank, whereby high quality surface treatment, for example, electrodeposition coating can be conducted by uniformly stirring the processing solution so as not to cause backflow or turbulence in the processing solution tank while dipping a work on a conveyor in the processing solution.

3 Claims, 4 Drawing Sheets

(a)
(b)
(c)
8
7
11
2
6
2
11
10
13
12

PROCESSING SOLUTION TANK

BACKGROUND OF THE INVENTION

1. Field of the Invention

The present invention concerns a processing solution tank of forming an agitating flow by flowing and circulating a processing solution in directions opposite to each other between the side of a liquid surface and the side of a tank bottom, and dipping a work conveyed by a conveyor in the processing solution, thereby conducting electrodeposition coating or other surface treatment.

2. Statement of Related Art

In electrodeposition coating, an electrodeposition coating material dissolved or dispersed in water at a solid concentration of 8 to 20% is contained in an electrodeposition tank, metal works are dipped therein and a DC voltage at about 100 to 300V is applied between the work and the electrode in the tank thereby electrically depositing the coating material ingredient (solids) present in the form of ions in the solution on the surface of the work at an opposite polarity to form coating layers.

In a case where the coating material conditions and the current supply condition are kept constant, coating can be applied at an identical distribution of layer thickness uniformly as far as shaded portions of the work with good depositability. Particularly, since the cationic electrodeposition coating method using a work as the cathode has excellent anti-rust performance not leaching metals from the work, this method is adopted for primary coating of most of automobile bodies.

FIG. 3 shows an existent electrodeposition apparatus 41 comprising a navicular electrodeposition tank (processing solution tank) 42 for dipping a work W such as an automobile body to be conveyed by a conveyor (not illustrated) and a sub-tank 44 provided on one end of the tank 42 for recovery of bubbles or dusts suspended to the liquid surface by way of an overflow dam 43.

At the bottom and on the side in the electrodeposition tank 42, are arranged a plurality of spray nozzles 45 for discharging an electrodeposition solution recovered in the sub-tank 44 thereby stirring the inside of the electrodeposition tank 42. Electrodes (not illustrated) are provided at the inside of the tank for forming electric fields relative to the work W, and current supply bars (not illustrated) for maintaining the work W to a polarity opposite to that of the electrodes are arranged along the conveyor.

For the spray nozzles 45, nozzles 45T arranged on the side of the liquid surface of the electrodeposition tank 42 are arranged forward in the conveying direction of the conveyor, while nozzles 45B arranged at the bottom of the tank are directed backward in the conveying direction of the conveyor, such that the electrodeposition solution forms an agitating flow flowing in the directions opposite to each other between the side of the liquid surface and the side of the tank bottom.

With the constitution, the coating material ingredients are agitated with no precipitation in the electrodeposition tank 42 to form more uniform coating layers.

However, in a case where high quality electrodeposition coating layers are required, it has been found that dusts such as iron powders and paint wastes are adhered on the surface to cause coating failure referred to as seeds even when the flow of the agitating flow is formed.

In electrodeposition coating of automobile bodies, the seeds are observed particularly at those portions of large horizontal area such as a roof or an engine hood situated at the upper half of the body but they are not formed so much on a fender or a door.

As a result of experiments and studies made by the present inventors, this is considered to be attributable to that dusts, etc. tend to be placed on the portions of the large horizontal area, as well as that the agitating flow is formed in the forward direction of the conveyor on the side of the liquid surface in which the upper half of the automobile body is dipped and, accordingly, the relative speed between the automobile body and the deposition solution is low.

In view of the above, an electrodeposition tank as shown in FIG. 4 was proposed in which a sub-tank 52 is provided on the inlet of an electrodeposition tank 51, all the spray nozzles in the tank 51 are directed backward relative to the conveying direction of the conveyor from the liquid surface to the lower portion of the tank to flow the electrodeposition solution only in the direction from the exit to the inlet of the tank, so as to increase the relative speed of the electrodeposition solution to the work W to be conveyed from the inlet to the exit of the tank.

However, when the present inventors have analyzed the flow of the electrodeposition solution in the electrodeposition tank 51 described above, it has been found that the solution does not always form a uni-directional stream in the electrodeposition 51 but partially formed backflow/turbulence as shown in FIGS. 5(*a*) and (*b*).

That is, since the spray nozzles 53 are arranged only at the lower portion and on the side of the tank, while the electrodeposition solution flows from the exit to the inlet of the tank in the portions along the bottom and the side of the tank, but it causes backflow/turbulence near the central portion.

FIG. 5(*a*) shows the flow at the vertical cross section for the central portion of the electrodeposition tank along the conveying line of the conveyor, in which a flow from the exit to the inlet of the tank is formed along the bottom of the tank but includes a great deal of backflow and also some turbulence.

Further, FIG. 5(*b*) shows the flow on the liquid surface. While a flow from the exit to the inlet of the tank is formed along right and left sides, it can be seen that the backflow/turbulence are formed along the center line.

As described above, even when the spray nozzles 53 are arranged in the identical direction intending to form a flow in one direction in the electrodeposition tank 51, since backflow/turbulence are formed near the central portion in which the automobile body is conveyed, seeds tend to be formed when the relative speed is lowered by backflow and since dusts are scattered upward by the turbulence, they have an increased probability of adhesion, both of which cause coating failure.

Further, when the electrodeposition tank 42 shown in FIG. 3 has been analyzed in the same manner, it has been found that backflow/turbulence also occur therein.

SUMMARY OF THE INVENTION

Then, the present invention has a technical subject of uniformly agitating the processing solution so as not to cause backflow or turbulence thereby enabling surface treatment at high quality.

In order to solve the subject described above, the present invention provides a processing solution tank of forming an agitating flow by flowing and circulating a processing solution in directions opposite to each other between the side of a liquid surface and the side of a tank bottom, and dipping a work conveyed by a conveyor in the processing solution, thereby conducting electrodeposition coating or other surface treatment, wherein a guide plate substantially of an arcuate shape is formed to an end of the tank situated at least to the downstream on the side of the liquid surface or the downstream on the side of the tank bottom in the agitating flow, for reversing the flow downward to the tank bottom or upward to the liquid surface, a swirl chamber having a swirl generating portion of a substantially arcuate face for capturing dusts is provided at the bottom of the tank, in which the flow inlet formed tangentially to the swirl generating portion opens opposing to the stream line of the agitating flow and a dust discharge port is formed to the swirl chamber.

According to the present invention, the end of the tank situated downstream to the agitating flow on the side of the liquid surface is formed with the guide plate substantially of an arcuate shape and, when the flow on the side of the liquid surface reaches the end of the tank at the downstream, it is reversed downward along the guide plate into a flow of the opposite direction formed on the side of the tank bottom.

Further, when the agitating flow flowing on the bottom of the tank reaches the end of the tank at the downstream, it is reversed upward along the guide plate of a substantially arcuate shape, and forms a flow in an opposite direction formed on the side of the liquid surface.

Accordingly, even when the agitating flow on the side of the liquid surface collides against the end of the tank, since it is reversed as it is to the downward direction, no backflow is formed on the side of the liquid surface. In the same manner, even when the agitating flow on the side of the tank bottom collides against the tank end, since it is reversed as it is to the upward direction, no backflow is formed on the side of the bottom, but circulating flows reversed upward and downward on both ends of the tank are formed.

Further, as the swirl chamber for capturing dusts is provided at the bottom of the tank and, when a portion of the agitating flow flowing on the tank bottom enters together with relatively heavy dusts of iron powders or coating material wastes into the swirl chamber from the flow inlet that opens opposing to the stream line direction, the processing solution is rotated in the swirl generating portion comprising the surface of the substantially arcuate shape into a swirl and a stagnation point is formed at the center of the swirl, to recover dusts in the swirl chamber.

Accordingly, when wastes water is drained at a predetermined flow rate from the dust discharging port formed to the swirl chamber, dusts accumulated in the swirl chamber are discharged.

BRIEF DESCRIPTION OF THE ACCOMPANYING DRAWINGS

FIG. 1 is an explanatory view showing an electrodeposition coating apparatus to which a processing solution tank according to the present invention is applied;

FIGS. 2(*a*), 2(*b*). and 2(*c*) are explanatory views showing a stream line therein;

Figure 5:
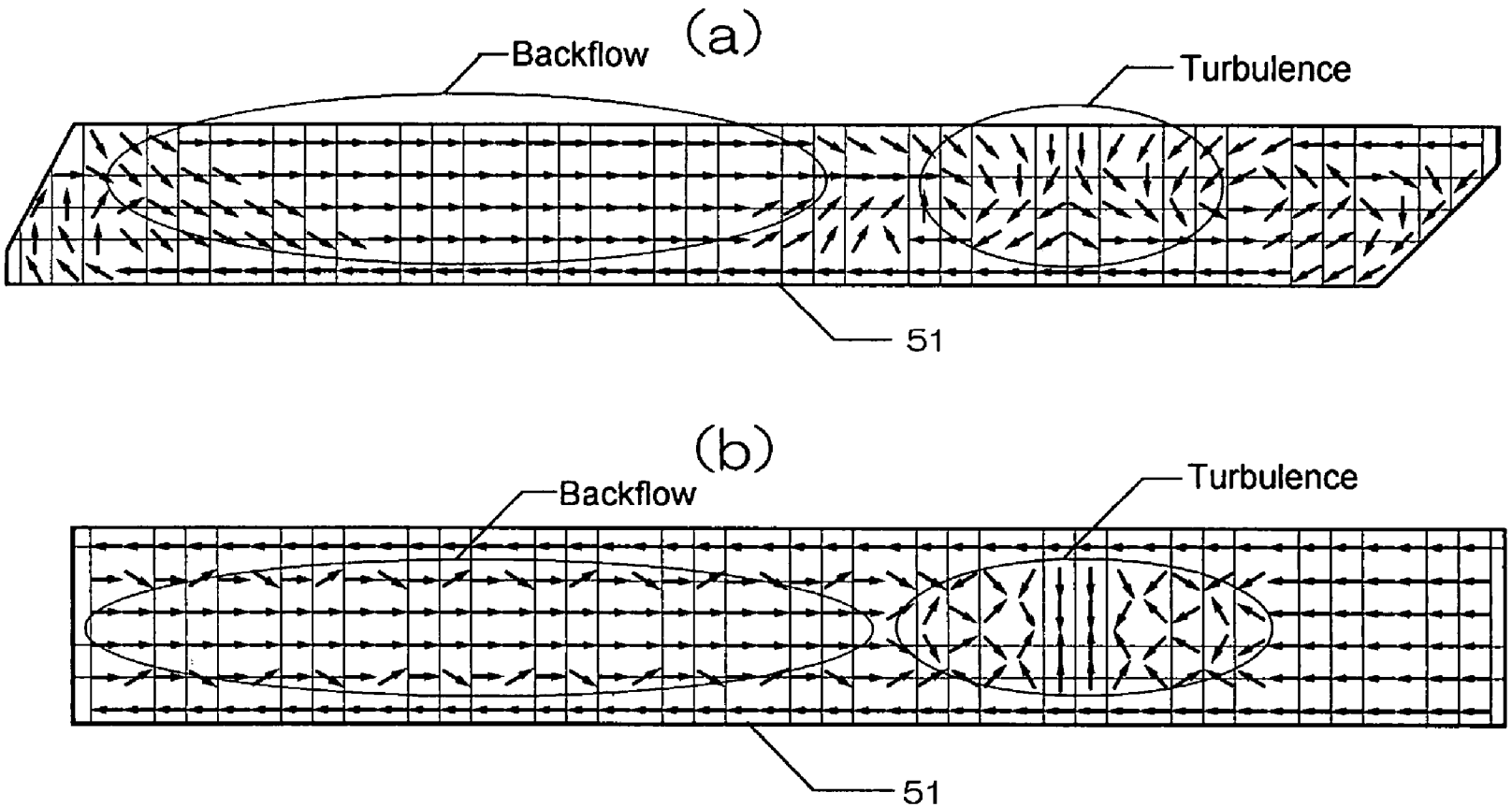
Fig. 5 (prior art)

FIGS. 5(*a*) and 5(*b*) are explanatory views showing the stream line in the existent apparatus.

DESCRIPTION OF PREFERRED EMBODIMENTS

The present invention is to be described specifically by way of a preferred embodiment with reference to the drawings.

Figure 1:
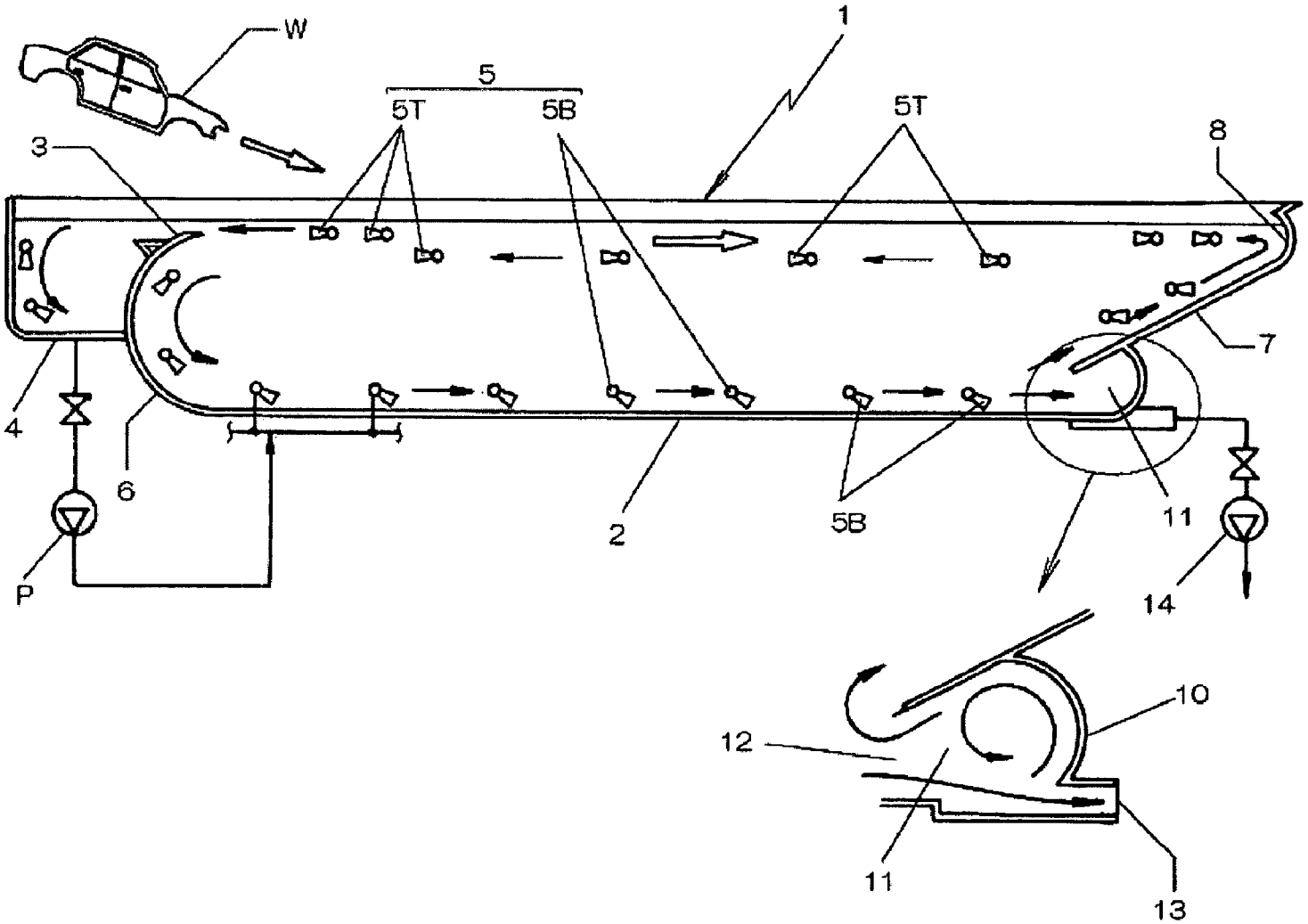

In an electrodeposition coating apparatus 1 shown in FIG. 1, a work W such as an automobile body conveyed by a conveyor (not illustrated) is dipped in an electrodeposition solution (processing solution) stored in an electrodeposition tank (processing solution tank 2) and applied with electrodeposition coating. A sub-tank 4 is provided on the inlet of the electrodeposition tank 2 for recovering bubbles or dusts suspended on the liquid surface by way of an overflow dam 3.

A plurality of spray nozzles 5 are disposed at the bottom and on the sides of the electrodeposition tank 2 for discharging the electrodeposition solution recovered to the sub-tank 4 by a pump P to agitate the inside of the electrodeposition tank 2. Electrodes in the tank (not illustrated) are provided for forming electric fields relative to the work, and current supply bars for keeping the work W at the polarity opposite to that of the electrodes are arranged along the conveyor.

For the plurality of spray nozzles 5, nozzles 5T on the side of the liquid surface in the upper half portion are arranged in the backward direction relative to the conveying direction of the conveyor to form an agitating flow directed from the exit to the inlet of the tank, while nozzles 5B on the side of the tank bottom in the lower half portion are arranged in the forward direction relative to the conveying direction of the conveyor to form an agitating flow directing from the inlet to the exit of the tank.

The end on the tank inlet of the electrodeposition tank 2 at the downstream of the agitating flow on the side of the liquid surface is formed as a guide plate 6 of an arcuate shape or a polygonal shape substantially of an arcuate shape (hereinafter simply referred to as "arcuate shape") for reversing the electrodeposition solution flowing along the liquid surface to the downward direction and guiding the same to the bottom of the tank, and the upper end edge of the guide plate 6 constitutes an overflow dam 3.

Further, a slope 7 is formed to the end on the exit of the electrodeposition tank 2 at the downstream of the agitating flow on the tank bottom along the conveying trace of the work W, and a guide plate 8 of an arcuate shape is formed to the top end of the slope 7 for reversing upward the electrodeposition solution flowing along the tank bottom and guiding the same to the liquid surface.

The tangential direction of the arcuate surfaces of the guide plates 6 and 8 are preferably aligned with the stream line of the agitating flow on the side of the liquid surface, and with the stream line of the agitating flow on the side of the tank bottom, respectively.

With the constitution described above, the agitating flow on the side of the liquid surface caused to flow by the spray nozzles 5T on the side of the liquid surface from the exit to the inlet of the tank is reversed downward along the arcuate surface of the guide plate 6 at the end of the tank inlet into an agitating flow from the inlet to the exit of the tank by the spray nozzles 5B at on the bottom of the tank and, further, reversed upward at the end of the tank exit along the arcuate surface of the guide plate 8, joins again with the agitating flow on the side of the liquid surface, thereby forming an agitating flow flowing and circulating to the directions opposite to each other on the side of the liquid surface and on the side of the bottom of the tank.

Further, on the exit at the bottom of the tank, a swirl flow chamber 11 for capturing dusts having a swirl flow generating portion 10 comprising an arcuate surface or a polygonal surface substantially of an arcuate surface (hereinafter simply referred to as "arcuate surface") is provided in which a flow inlet 12 formed in the tangential direction of the swirl generating portion 10 opens opposing to the direction of the stream line of the agitating flow, and a dust discharge port 13 formed to the swirl flow chamber 11 is connected with a drain pump 14.

Accordingly, when a portion of the electrodeposition solution flowing along the bottom of the tank enters from the flow inlet 12 into the swirl generating portion 10, since the flow stagnates as a swirl along the arcuate surface, dusts such as iron powder or coating material wastes carried from the electrodeposition tank 2 are recovered and the recovered dusts are discharged by operating the drain pump 14.

The electrodeposition coating apparatus to which the processing solution tank according to this invention is applied has the constitution as has been described above, and the operation thereof is to be explained with reference to FIG. 2.

At first, when the pump P is operated to discharge the electrodeposition solution from each of the spray nozzles 5, an agitating flow directed from the exit to the inlet of the tank is formed on the side of the liquid surface of the electrodeposition tank 2, and an agitating flow directed from the inlet to the exit of the tank is formed on the side of the tank bottom.

Then, when the agitating flow on the side of the liquid surface caused to flow by the spray nozzles 5T from the exit to the inlet of the tank reaches the end on the inlet of the electrodeposition tank 2, most of the agitating flow is reversed downward along the arcuate guide plate 6, except for the portion riding over the overflow dam 3 together with bubbles or dusts suspended on the liquid surface to the sub tank 4, and urged by the jetting stream of the electrodeposition solution discharged from the spray nozzles 5B on the side of the tank bottom to form an agitating flow directed from the inlet to the exit of the tank.

When the agitating flow on the side of the tank bottom caused to flow by the spray nozzles 5B on the side of the tank bottom from the inlet to the exit of the tank reaches the end on the side of the exit of the electrodeposition tank 2, most of the agitating flow, except for the portion flown into the swirl chamber 11 along the tank bottom, is guided along the slope 7 to the side of the liquid surface and reversed upward along the arcuate guide plate 8 formed to the top end thereof, and urged by the jet stream of the electrodeposition solution discharged from the spray nozzles 5T on the side of the liquid surface to form an agitating flow directed from the exit to the inlet of the tank.

As described above, at the end of the inlet and the end of the exit of the electrodeposition tank 2, the electrodeposition solutions are guided by the guide plates 6 and 8, respectively such that they are reversed downward and upward to turn the directions of flows thereby forming an agitating flow that circulates so as to draw an elliptic stream line as a whole when observed on the side of the lateral surface.

Figure 2:
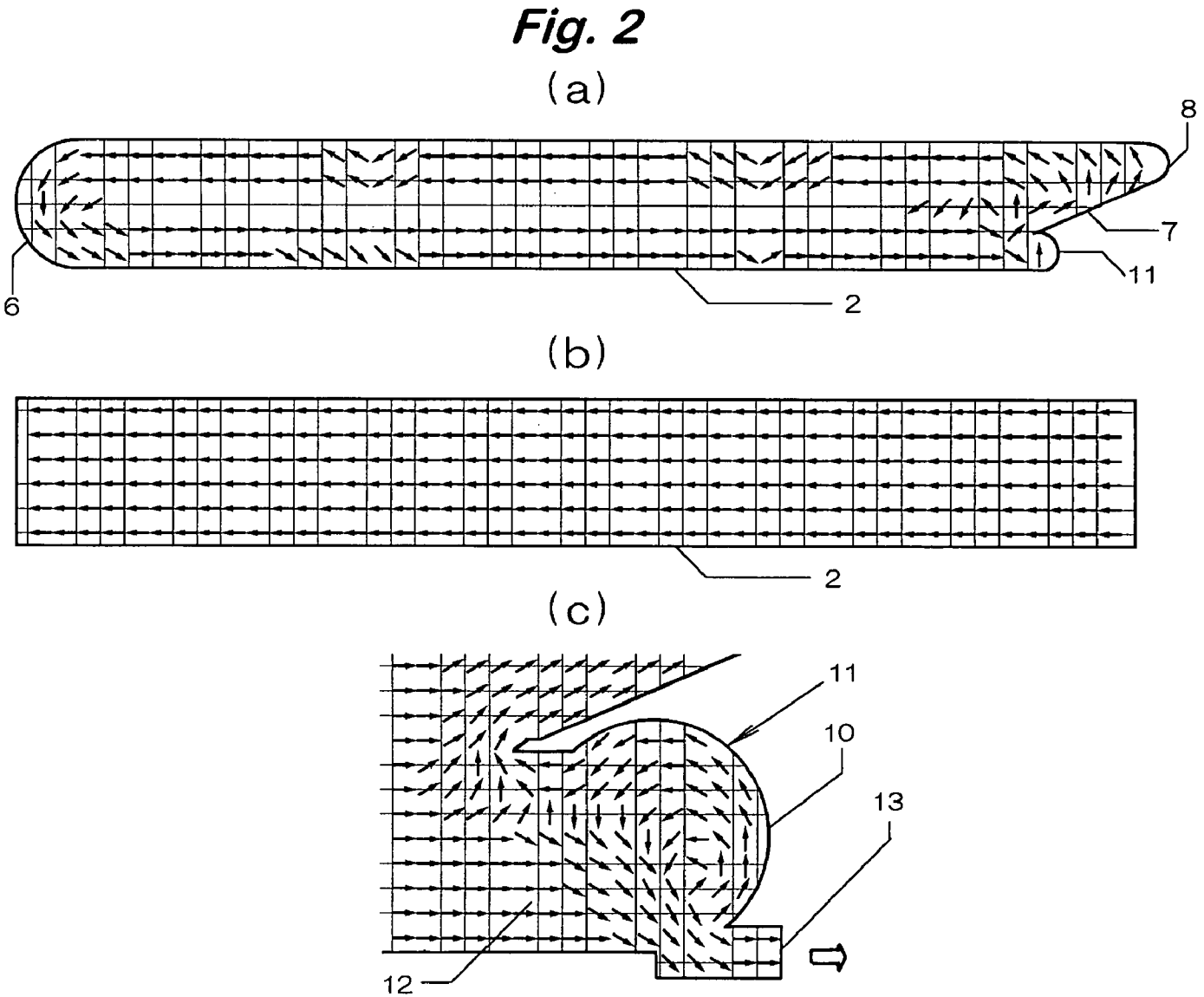
Figure 3:
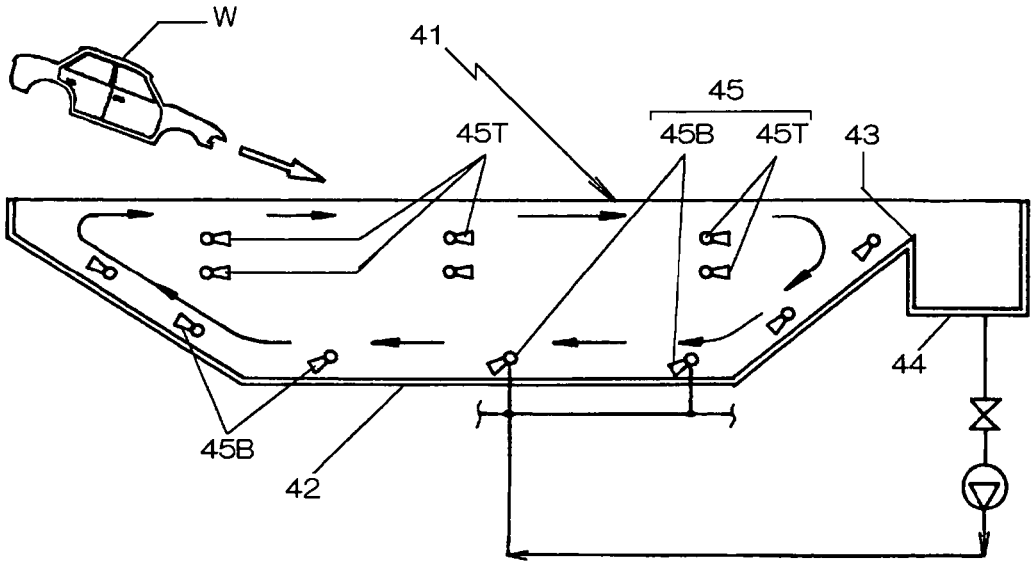
Fig. 3 ( prior art )
FIG. 3 is an explanatory view showing an existent apparatus.
Figure 4:
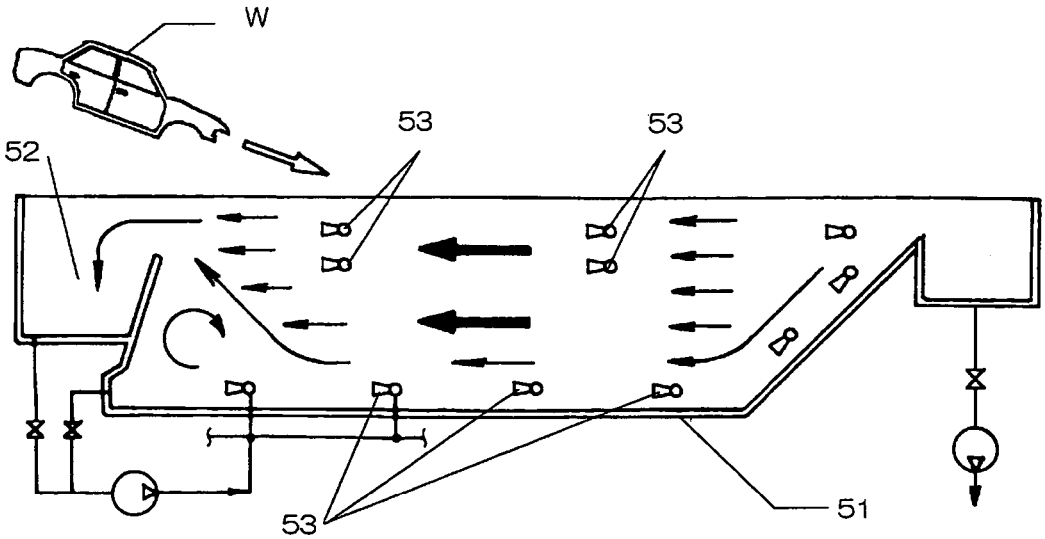
Fig. 4 ( prior art )
FIG. 4 is an explanatory view showing an existent apparatus.

Accordingly, as shown in FIG. 2(*a*), it can be seen for flow in the vertical cross section taken along the conveying line of the conveyor for the central portion of the electrodeposition tank 2 that the agitating flow on the side of the liquid surface from the exit to the inlet of the tank is reversed downward at the end of the tank inlet to form an agitating flow on the side of the bottom directing from the inlet to the exit of the tank, reversed again upward at the end of the tank exit to form an agitating flow on the side of the liquid surface from the exit to the inlet of the tank and that backflow and turbulence are scarcely formed in the midway.

Further, as shown in FIG. 2(*b*), also the flow at the liquid surface forms an agitating flow of a substantially uniform velocity distribution for the entire liquid surface from the exit to the inlet of the tank and neither backflow nor turbulence is formed in the midway.

When the agitating flow on the side of the tank bottom flows into the swirl chamber 11 at the end of the exit of the electrodeposition tank 2, since the flow inlet 12 is formed in the tangential direction of the swirl generating portion 10 comprising an arcuate face, the agitating flow rotates along the arcuate face of the swirl generating portion 10 as shown in FIG. 2(*c*) to form a swirl.

In this case, since the agitating flow at a relatively high flow speed flowing along the tank bottom flows linearly into the swirl generating portion 10, dusts such as relatively heavy iron powder or coating material wastes are carried being entrained on the flow into the swirl chamber 11 and the center of the swirl constitutes the stagnation point, so that, dusts are dropped into the swirl chamber 11 and recovered.

In this process, dusts in the swirl chamber 11 can be recovered by draining the electrodeposition solution each in a required amount from the discharging port 13 by the drain pump 14 and dusts are not sent again into the electrodeposition tank 2 and coating failure such as seeds caused by adhesion of dusts can be decreased more reliably.

Then, the electrodeposition solution in the swirl chamber 11 is urged by the electrodeposition solution flowing from the flowing inlet 12 and flows again from the flow inlet 12 into the electrodeposition tank 2 and joins the agitating flow on the side of the tank bottom.

As described above, as viewed from the lateral side of the electrodeposition tank 2, since the agitating flow of the electrodeposition solution circulating entirely so as to draw an elliptic stream line is formed and neither backflow nor turbulence is caused, the relative speed is not retarded by the backflow or dusts causing seeds by the turbulence are not scattered upward and, since dusts in the electrodeposition tank 2 attributable to the seeds are captured in the swirl chamber 11, coating failure is less caused.

While the descriptions have been made to a case of forming the agitating flow on the side of the liquid surface directing from the exit to the inlet of the tank and the agitating flow on the side of the tank bottom directing from the inlet to the exit of the tank, the invention is not restricted only thereto, but it may be a case of forming the agitating flow on the side of the liquid surface from the inlet to the exit of the tank and the agitating flow on the side of the tank bottom directing from the exit to the inlet of the tank.

However, coating failure such as seeds less occurs in the former embodiment since the relative speed between the work W and the electrodeposition solution is increased.

Further, while descriptions have been made to the case of forming the arcuate guide plates 6 and 8 on both ends of the electrodeposition tank 2, it has been demonstrated by the experiment for the invention that coating failure less occurs when the guide plate is formed at least on one end.

Further, the swirl chamber 11 may provided not only to the end of the tank exit on the tank bottom but also it may be provided at the end on the tank inlet. That is, a portion of the agitating flow can be intaken reliably so long as the chamber is provided to a portion where the stream line of the agitating flow is changed. However, provision of the chamber to the downstream of the agitating flow (at the end on the tank exit in this embodiment) flowing on the side of the tank bottom can provide an advantage capable of recovering dusts fallen on the tank bottom more easily.

As has been described above according to the present invention, when the agitating flow flowing on the side of the liquid surface reaches the end of the tank at the downstream thereof, the flow is reversed downward along the arcuate guide plate and, when the agitating flow flowing on the side of the tank bottom reaches the tank end at the downstream thereof, the flow is reversed upward along the arcuate guide plate, thereby forming the agitating flow of the electrodeposition solution that circulates so as to draw an elliptic stream line entirely. Accordingly, the relative speed is not retarded by the formation of the backflow or dusts are not scattered upward by the generation of swirl attributable to seeds, and it can provide excellent effect of less causing coating failure.

Further, since a portion of the agitating flow flowing along the tank bottom flows together with dusts such as relative heavy iron powder and coating wastes into the dust capturing swirl chamber provided at the bottom of the tank and the stagnation point is formed at the center of the swirl flow generated in the swirl generating portion, it can provide excellent effect capable of capturing dusts in the swirl chamber.

The present invention is applicable to an application use as a processing solution tank of forming an agitating flow by flowing and circulating a processing solution in directions opposite to each other between the side of a liquid surface and the side of a tank bottom, and dipping a work conveyed by a conveyor in the processing solution, thereby conducting electrodeposition coating or other surface treatment.

The present disclosure relates to subject matter contained in priority Japanese Patent Application No. 2003-434,705 filed on Dec. 26, 2003, the contents of which is herein expressly incorporated by reference in its entirety.

What is claimed is:

1. An electrodeposition tank which circulates a processing solution, the processing solution tank circulating the processing solution in a first direction at an upper part of the processing solution tank and circulating the processing solution in a second direction opposite to the first direction at a lower part of the processing solution tank to generate an agitating flow, the processing solution tank comprising:

at least one of a guide plate, located at an end of the processing solution tank downstream from a part of the processing solution flowing in the first direction, which reverses a flow of the processing solution by directing the flow of the processing solution towards a bottom of the processing solution tank, and a guide plate, located at an end of the processing solution tank which is downstream from a part of the processing solution flowing in the second direction, which reverses the flow of the processing solution by directing a flow of the processing solution toward a surface of the processing solution; and a swirl chamber which removes dust from the processing solution, comprising an inlet, a swirl generator formed opposite the inlet and having a substantially arcuate shape, and a dust discharge port.

2. An electrodeposition tank according to claim 1, wherein each guide plate has a substantially arcuate shape.

3. An electrodeposition tank according to claim 1, wherein the swirl chamber is formed underneath the guide plate which reverses the flow of the processing solution by directing a flow of the processing solution toward a surface of the processing solution.

* * * * *